US005640147A

United States Patent [19]

Chek et al.

[11] Patent Number: 5,640,147

[45] Date of Patent: Jun. 17, 1997

[54] CHILD MONITORING DEVICE

[76] Inventors: Lawrence Chek, 3219 Basil Ct., Dallas, Tex. 75204; Thomas C. Steidel, 204 Kimport Ave., Boalsburg, Pa. 16827

[21] Appl. No.: 585,956

[22] Filed: Jan. 16, 1996

[51] Int. Cl.[6] ..... G08B 23/00

[52] U.S. Cl. ..... 340/573; 340/574; 379/38; 381/56; 455/88

[58] Field of Search ..... 340/573, 574, 340/539, 692; 381/56; 455/88, 89, 351; 379/37, 38, 102

[56] References Cited

U.S. PATENT DOCUMENTS

| | | | |
|---|---|---|---|
| 4,459,434 | 7/1984 | Benning et al. | 379/102 X |
| 4,598,272 | 7/1986 | Cox | 340/539 |
| 4,694,284 | 9/1987 | Leveille et al. | 340/574 |
| 4,851,823 | 7/1989 | Mori | 340/692 X |
| 5,119,072 | 6/1992 | Hemingway | 340/573 |
| 5,210,532 | 5/1993 | Knoedler et al. | 340/573 X |
| 5,280,635 | 1/1994 | Knoedler et al. | 455/351 X |
| 5,305,370 | 4/1994 | Kearns et al. | 379/38 X |
| 5,333,172 | 7/1994 | Stevens | 379/38 |
| 5,400,011 | 3/1995 | Sutton | 340/692 X |
| 5,533,959 | 7/1996 | Newman et al. | 340/573 X |

FOREIGN PATENT DOCUMENTS 1150430 4/1969 United Kingdom .

*Primary Examiner*—Thomas Mullen
*Attorney, Agent, or Firm*—Jenkens & Gilchrist

[57] ABSTRACT

A method for remotely monitoring the activities of a minor or dependent child or adult, on command from a parent unit. The child unit contains a sensitive audio microphone to provide the holder of the parent unit the capability to periodically listen to activity in close proximity of the child unit, thereby offering the holder of the parent unit a measure of confidence in the state of well-being of the holder of the child unit. The preferred embodiment provides a means to transmit an alert signal from the child unit to the parent unit in the event of an emergency. The transmission media used to interconnect both units is wireless, and may comprise radio frequency or infrared optical means, or any combination thereof.

10 Claims, 3 Drawing Sheets

PARENT UNIT COMPRISING
MONITORING AND CONTROL MEANS

CHILD UNIT COMPRISING CHILD–MOUNTABLE MEANS

CHILD MONITORING DEVICE

BACKGROUND OF THE INVENTION

1. Technical Field of the Invention

The present invention relates to a novel apparatus and method for monitoring the activity of children, and in particular, to a device and method for the remote monitoring of the activities of a child away from the parent.

2. Description of Related Art

Pagers and cellular telephones are well known in the art. However, the "marriage" of this type of technology in an environment used to monitor the activities of a minor child in a day care facility has not been used previously. Conventional cellular phones to be used by an infant or toddler is unrealistic in its application. Specifically, it is quite likely that a minor child or a toddler would be incapable of operating or answering a cellular phone in any appropriate manner. In addition, the likelihood of inadvertent activation and the consequent increase in cellular air time charges is a likely possibility. What is provided in this invention is a portable, battery operated, communication system designed specifically for the monitoring of, for example, a minor child who might not be capable, due to their age or the like, of operating a conventional transmitting unit which would be attached to their person.

SUMMARY OF THE INVENTION

Various advantages and objects of this invention would be readily apparent upon reading the accompanying drawings and the descriptions set forth herein. Specifically, one of the objects of this invention is to provide a mechanism and method for monitoring the activities and well-being of a minor child, such as a toddler who has been placed in day care. This type of device allows a parent to monitor the activities of the child in an expeditious manner.

One of the advantages of Applicant's invention is that the minor child wears a small unobtrusive device which allows for the monitoring of the child's well-being by the parent while the child is in the day care center, in a far more expeditious manner than would have been possible.

Yet another advantage of Applicant's invention is the ability to monitor a child in the event of harm by controlling and providing a mechanism by which an alarm or notification is given to the parent if the monitoring device is removed or an attempt is made to remove from the child in any manner. This antitampering function provides significant advantages over prior art systems. Yet another advantage is an ability to monitor if the child wearing the device is or has been removed from the day care setting.

BRIEF DESCRIPTION OF THE DRAWINGS

A more complete understanding of the apparatus and method of this invention may be had by reference to the following detailed description when read in conjunction with the accompanying drawings herein.

DETAILED DESCRIPTION OF THE PRESENTLY PREFERRED EXEMPLARY EMBODIMENTS

Figure 1:
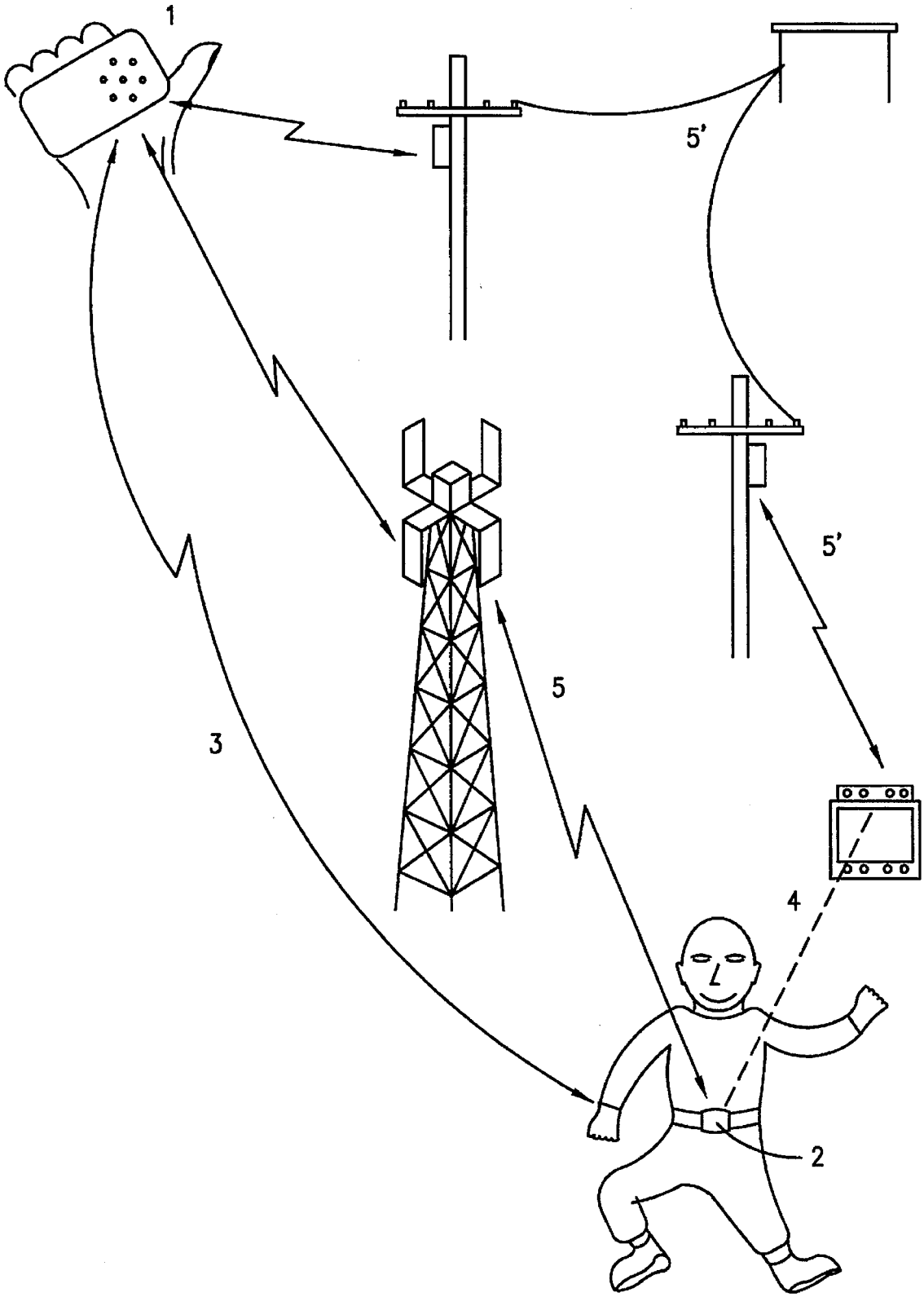
FIG. 1 is a system overview of the various communication paths that would connect the device that is placed on the child and the handheld unit used by the parent.
Figure 2:
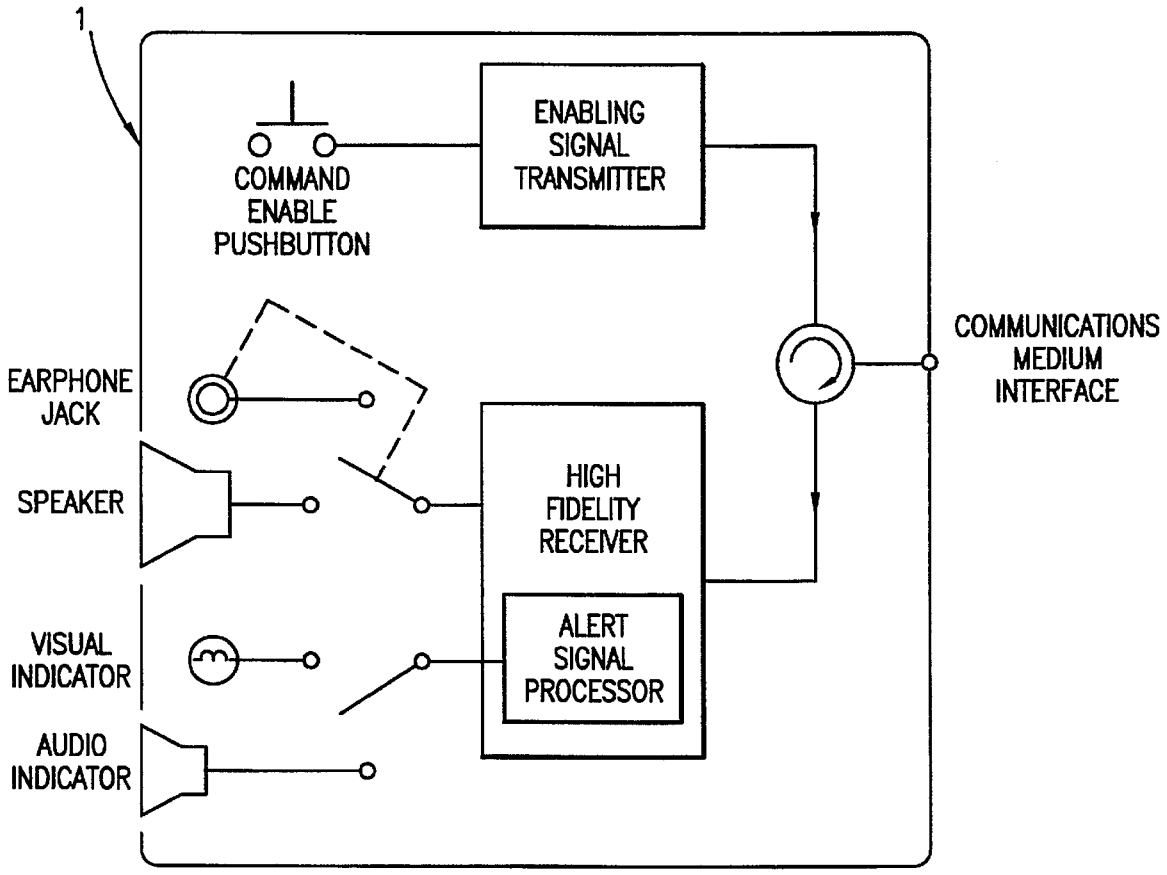
FIG. 2 is a more detailed block diagram of the unit 1 of FIG. 1.

As can be seen from FIG. 1, the communication arrangement of this invention provides for a handheld pager-like device that the parent uses which may use various communication paths to activate the unit 2 which is attached to the clothing of the minor or infant child. This unit 1 of FIG. 1 is shown in more detail in the block diagram of FIG. 2, wherein the command enable push button is used by the parent to activate an enabling signaling transmitter which transmits over the communication medium, which may be either a direct wireless connection 3, a cellular phone connection such as shown in link 5 or a landline wire connection which is shown in 5' of FIG. 1. Once the enable signal is transmitted from the device 1 to a corresponding circuit in the child unit described, in more detail below with respect to FIG. 3, it activates the child's unit and allows for the reception of sound on the child's unit which is then transmitted back through the communication medium to the high fidelity receiver, thereby allowing sounds that exist around the child to be heard, either through the speaker or the earphone jack of the device shown in FIG. 2. The parental unit is equipped with the means to transmit the enabling signal to the child's unit on an individual command. This limits the amount of activation time and service costs as well as extending the battery life of both units. It is envisioned that the parent unit be small enough to either be carried in a coat pocket, purse or brief case or worn on a belt.

Figure 3:
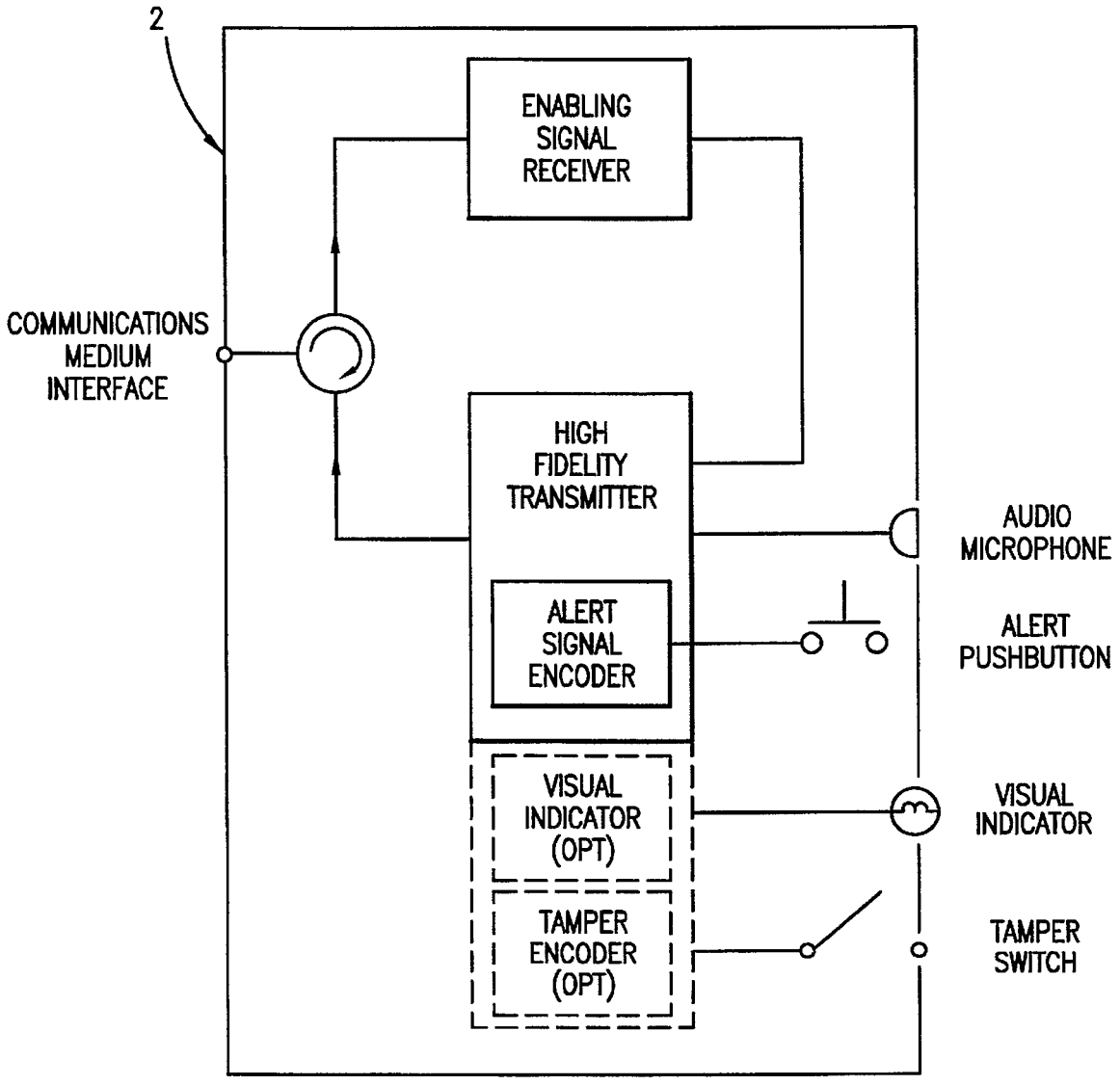
FIG. 3 is a more detailed block diagram of the unit 2 shown in FIG. 1.

The unit shown in FIG. 3 is the child's unit which is intended to be mounted on the clothing of the child and which has optionally a tamper resistant switch which allows for the immediate activation of the device in the event that the device is removed from the child's clothing. Optionally a visual indicator is provided which will provide indication that the device is in operation. In addition to receiving over the communication interface, the enable signal which will turn on the audio microphone and the transmitter to retransmit sounds that are existing in the area around the child, there is additionally provided an alert signal encoder which allows the child, an attending adult or an older child to press a button which will automatically activate a paging type of function in the device used by the parent of FIG. 2. This provides an increased measure of security for the child knowing that in the event of any trouble a simple push button will alert the parent quickly.

On a local communication level, the unit 2 shown in FIG. 3 which is the child unit, in addition possibly to using a cellular or pure RF communication link to the parental unit, may also use an optical or infrared link 4 to, for example, a CATV-type receiver interface which is then connected through regular cable lines to an RF communications means. Flexibility in communications means provides the user the option to tailor parameters such as range, reliability and cost-of-service to meet individual needs and local availability. This communication link may be as noted above, infrared, radio frequency, cellular phone communication or conventional paging type of systems, or alternatively, individual frequency bands may be allocated in the future.

Although a preferred embodiment of the method and apparatus of the present invention has been illustrated in the accompanying drawings and described in the foregoing detailed description, it will be understood that the invention is not limited to the embodiment disclosed, but is capable of numerous rearrangements, modifications and substitutions without departing from the spirit of the invention as set forth and defined by the following claims.

What is claimed is:

1. A system for monitoring the activity of a child, comprising:

a monitoring and control means for transmitting at least one system-enabling signal, and for receiving audio signals; and a child-mountable means for transmitting in response to the receipt of at least one of said system-enabling signals any audio detected in the immediate proximity to said child.

2. The system of claim 1 wherein said monitoring and control means further comprises:

a transceiver having a command transmitter and a high-fidelity receiver.

3. The system of claim 1 wherein said child-mountable means further comprises:

a transceiver having a command receiver, a sensitive audio microphone, and a high-fidelity transmitter having its output modulated by said audio signals detected by said audio microphone.

4. The system of claim 1 wherein said child-mountable means further comprises:

a means to transmit an alert signal; and said monitoring and control means further comprises a means to receive said alert signal and to alert an individual.

5. The system of claim 1 wherein both said monitoring and control, and child-mountable means further comprise means to transmit and receive signals via radio frequency transmissions.

6. The system of claim 1 wherein both said monitoring and control, and child-mountable means further comprise means to transmit and receive signals via optical transmissions.

7. The system of claim 1 wherein both said monitoring and control, and child-mountable means further comprise means to transmit and receive signals via external radio frequency communications resources.

8. The system of claim 1 wherein said child-mountable means is further comprised of a visual indication to confirm that said child-mountable means has been enabled by said monitoring and control means.

9. The system of claim 1 wherein said child-mountable means further comprises:

a means to transmit an alarm to said monitoring and control means if said child-mountable means is removed from said child.

10. A system as in claim 1 wherein said child-mountable means further comprises:

tamper signal means for activating and transmitting a signal in response to any tampering or removal of said child-mountable means from said child.

* * * * *